US010746452B2

(12) United States Patent
Chen et al.

(10) Patent No.: US 10,746,452 B2
(45) Date of Patent: Aug. 18, 2020

(54) ICE CUTTING TRAY

(71) Applicant: WHIRLPOOL CORPORATION, Benton Harbor, MI (US)

(72) Inventors: Binglai Chen, Stevensville, MI (US); Alexander Edward Caine, East Lansing, MI (US); Abigail Jean Livingston, East Lansing, MI (US); Darby Marie Spiegel, East Lansing, MI (US); Morgan Aileen Weber, East Lansing, MI (US); Abigail Caroline Wulf, East Lansing, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 220 days.

(21) Appl. No.: 15/834,813

(22) Filed: Dec. 7, 2017

(65) Prior Publication Data

US 2018/0164015 A1 Jun. 14, 2018

Related U.S. Application Data

(60) Provisional application No. 62/431,667, filed on Dec. 8, 2016.

(51) Int. Cl.

| | |
|---|---|
| ***F25C 5/00*** | (2018.01) |
| ***F25C 5/08*** | (2006.01) |
| ***F25C 1/12*** | (2006.01) |
| ***F25C 5/14*** | (2006.01) |
| ***F25C 1/16*** | (2006.01) |

(52) U.S. Cl.

CPC ..... *F25C 5/08* (2013.01); *F25C 1/12* (2013.01); *F25C 1/16* (2013.01); *F25C 5/14* (2013.01)

(58) Field of Classification Search

CPC ..... F25C 5/08; F25C 1/12; F25C 1/16; F25C 5/14

See application file for complete search history.

(56) References Cited

U.S. PATENT DOCUMENTS

| | | | | | |
|---|---|---|---|---|---|
| 3,423,949 | A * | 1/1969 | Esser | F25C 1/12 | 219/201 |
| 3,430,452 | A * | 3/1969 | Dedricks | F25C 1/12 | 62/137 |
| 4,009,595 | A * | 3/1977 | Barnard | F25C 1/12 | 62/300 |
| 5,187,948 | A * | 2/1993 | Frohbieter | F25C 1/08 | 62/351 |
| 5,823,001 | A * | 10/1998 | Patrick | F25C 1/04 | 62/135 |
| 6,508,075 | B1 * | 1/2003 | Shipley | F25C 1/06 | 62/347 |
| 7,082,782 | B2 * | 8/2006 | Schlosser | F25C 1/06 | 62/347 |

* cited by examiner

*Primary Examiner* — Eric S Ruppert
(74) *Attorney, Agent, or Firm* — Price Heneveld LLP

(57) ABSTRACT

An ice maker includes an ice making unit and an ice storage bin. A frame is positioned between the ice making unit and the storage bin. An ice making tray is coupled with the frame, including a base defining a first plurality of apertures and a second plurality of apertures. A plurality of ice forming features is positioned proximate the first plurality of apertures. The ice forming features are coupled to and extend away from the base. A heating element is in thermal communication with the ice forming features. A wastewater disposal assembly is coupled with the ice making tray.

20 Claims, 10 Drawing Sheets

ICE CUTTING TRAY

CROSS-REFERENCE TO RELATED APPLICATION

This application claims priority to and the benefit under 35 U.S.C. § 119(e) of U.S. Provisional Patent Application No. 62/431,667, filed on Dec. 8, 2016, entitled ICE CUTTING TRAY, the entire disclosure of which is hereby incorporated herein by reference.

FIELD OF THE DISCLOSURE

The present disclosure generally relates to ice cutting trays, and more particularly relates to interchangeable ice cutting trays.

BACKGROUND

The formation of ice pieces in various shapes may be advantageous, however, providing an ice forming apparatus which may form a variety of shapes may be costly and labor intensive. Accordingly, new methods of forming ice pieces in various shapes may be advantageous.

SUMMARY OF THE DISCLOSURE

According to at least one feature of the present disclosure, an ice maker includes an ice making unit and an ice storage bin. A frame is positioned between the ice making unit and the storage bin. An ice making tray is coupled with the frame, including a base defining a first plurality of apertures and a second plurality of apertures. A plurality of ice forming features is positioned proximate the first plurality of apertures. The ice forming features are coupled to and extend away from the base. A heating element is in thermal communication with the ice forming features. A wastewater disposal assembly is coupled with the ice making tray.

According to at least one feature of the present disclosure, an ice maker includes an ice making unit configured to form an ice slab. A frame is positioned proximate the ice making unit. An ice making tray is coupled with the frame that includes a base that defines a first plurality of apertures and a second plurality of apertures. A plurality of ice forming features is positioned proximate the first plurality of apertures. The ice forming features are coupled to and extend away from the base. A heating element is in thermal communication with the ice forming features.

According to at least one feature of the present disclosure, a method of forming shaped ice, including the steps: forming an ice slab in an ice making unit; dispensing the ice slab onto an ice making tray to contact a plurality of ice forming features extending away from a base of the ice making tray; heating the plurality of ice forming features such that the slab is separated into a plurality of ice pieces and waste ice; passing the ice pieces through the ice forming features; and melting the waste ice into wastewater.

These and other features, advantages, and objects of the present disclosure will be further understood and appreciated by those skilled in the art by reference to the following specification, claims, and appended drawings.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Additional features and advantages of the invention will be set forth in the detailed description which follows and will be apparent to those skilled in the art from the description, or recognized by practicing the invention as described in the following description, together with the claims and appended drawings.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions.

Figure 1:
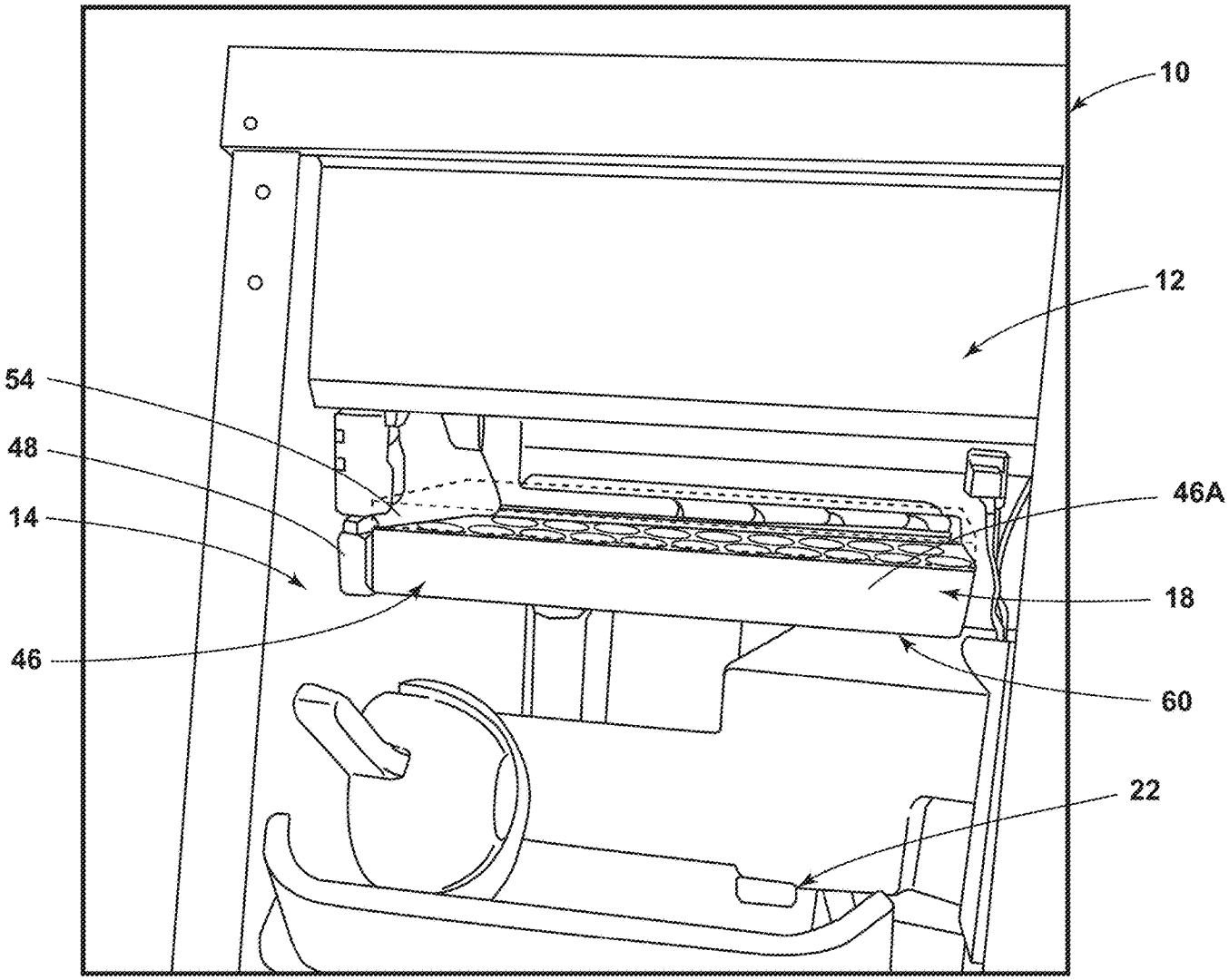
FIG. 1 is a perspective view of an ice maker, according to at least one example.
Figure 2:
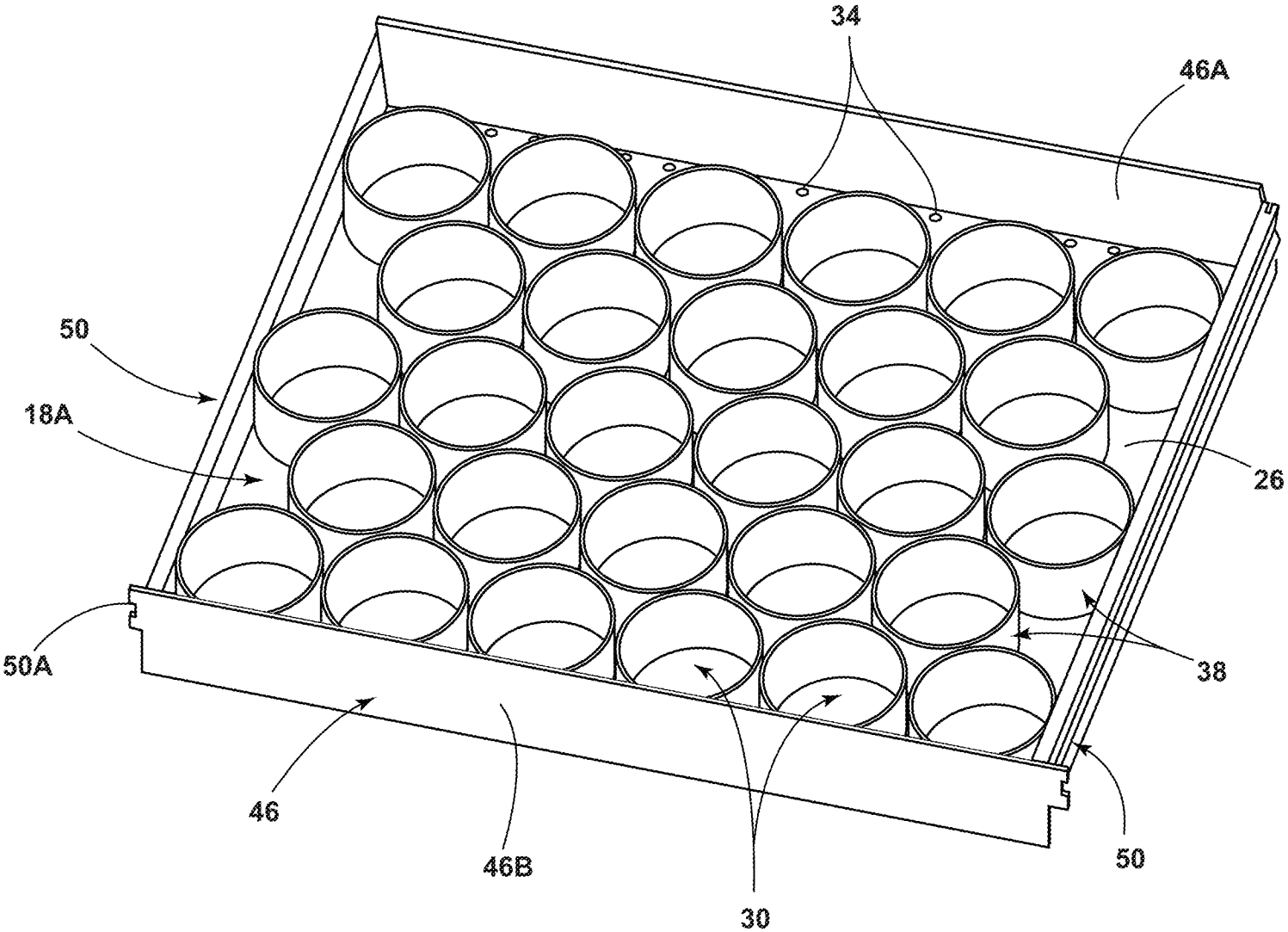
FIG. 2 is a perspective view of an ice making tray, according to at least one example.
Figure 3:
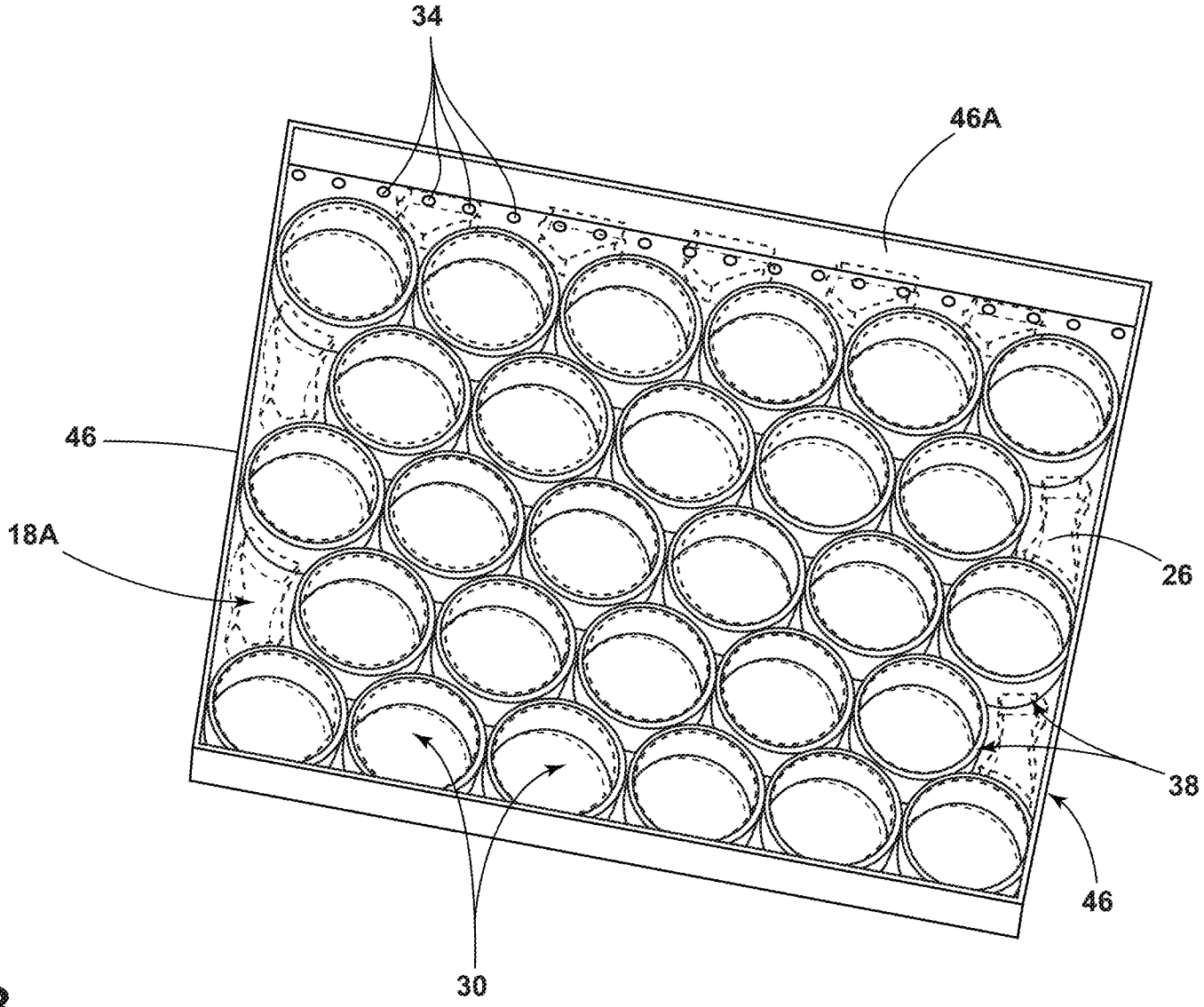
FIG. 3 is a perspective view of an ice making tray, according to at least one example.

Referring now to FIG. 1 depicted is an ice maker 10 including an ice making unit 12. The ice maker 10 defines an internal cavity 14. An ice making tray 18 is positioned within the internal cavity 14. An ice storage bin 22 is positioned below the ice making tray 18. According to various examples, the ice making unit 12 of the ice maker 10 is configured to create a slab of ice and slide the slab onto the ice making tray 18. The slab of ice maybe cut into a plurality of ice pieces by the ice making tray 18. The plurality of ice pieces may then fall through the tray 18 and be stored in the ice storage bin 22.

The ice making unit 12 may include a cooling system, a chilling plate and a water source. According to various examples, the cooling system may be thermally coupled to the chilling plate such that heat may be extracted from the chilling plate. The cooling system may include a fluid pump, a condenser and an evaporator. In yet other examples, the cooling system may include a thermoelectric device. According to various examples, the chilling plate may be angled relative to a horizontal plane of the ice maker. The water source is configured to flow water onto the chilled plate. The water source may dispense the water at a single point location, in a plurality of locations or may dispense the water in a continuous or semi-continuous manner across the chilling plate. In some examples, the water source may include a purifying system such that gases and/or particulates are filtered out prior to being dispensed onto the chilling plate. As the water is dispensed from the water source, the angle of the chilling plate allows the water to run across the chilling plate. Such movement of the water allows the ice slab to be formed as a plurality of concentric layers of ice. As the ice slab is created, the angle of the chilling layer allows the slab to be free of sediment and air bubbles, thus creating a pure and clear ice slab. The ice slab may be released from the plate via a heating system. In operation, the heating system heats the chilling plate such that bonds between the slab and the plate are severed and the ice slab may move independently from the chilling plate. The heating system may include one or more resistive elements configured to heat the chilling plate. In yet other examples, the heating system may be combined with the thermoelectric device of the cooling assembly. In such examples, current across the thermoelectric device may be reversed such that the thermoelectric device may generate the heat. Heating of the chilling plate may allow the ice slab to slide or otherwise be transferred to the ice making tray. As such, the ice making unit 12 is configured to produce the ice slab and dispense the ice slab onto the ice making tray 18.

Referring now to FIGS. 2-8, the ice making tray 18 includes a base 26 defining a first plurality of apertures 30 and a second plurality of apertures 34. A plurality of ice forming features 38 are coupled to and extend away from the base 26. A heating element 42 is in thermal communication with the ice forming features 38. A plurality of side walls 46 surround the base 26 and extend upwardly away from the base 26.

Referring now to FIGS. 2-5, in the depicted examples, the side walls 46 surround the base 26. The side walls 46 may be integrally formed by the base 26 or coupled thereto. For example, the side walls 46 may be formed via bending flanges of the base 26 in an upward manner to form the side walls 46. In other examples, the side walls 46 may be separate components welded and/or otherwise joined to the base 26. The side walls 46 may be formed of the same material (e.g., a metal) as the base 26 or may be formed of a different material (e.g., a polymeric material, ceramic and/or composite material). The side walls 46 include a front wall 46A. The front wall 46A of the side walls 46 may be positioned at a front side of the ice making tray 18 proximate a door of the ice maker 10. The front wall 46A may be taller than the rest of the side walls 46. In other words, the front wall 46A extends a greater distance from the base 26 than the side walls 46. The additional height of the front wall 46A may allow the slab of ice which has slid onto the ice making tray 18 to be retained in position above the ice forming features 38. In other words, the ice slab may be in contact with the front wall 46A. It will be understood that depending on the configuration of the ice making unit 12, one or more of the other side walls 46 may be elevated to retain the ice slab.

A frame 48 may be positioned within the ice maker 10. The frame 48 may be generally "U-shaped." The frame 48 defines a top lip 48A and a bottom lip 48B. According to various examples, the tray 18 may be slid in and out of the frame 48. For example, the side walls 46 may rest on, and be supported by, the bottom lip 48B. As such, the frame 48 may always remain in the ice maker 10. Such an example may be advantageous in that the whole frame 48 may not need to be replaced to change the shape of ice pieces formed by the tray 18. According to various examples, the frame 48 may include one or more locking features configured to engage with the ice making tray 18. For example, the frame 48 may define one or more protrusions configured to mate with a feature of the side walls 46. In yet other examples, the ice making tray 18 may be friction fit within the frame 48.

The base 26 and the side walls 46 cooperate to define a tray space 18A within which the ice forming features 38 are positioned. The side walls 46 may include a handle which is fixed or may fold (e.g., hinged). In hinged examples of the handle, the handle may fold to an undeployed position which renders it substantially planar with the side walls 46. The handle may be positioned on the front wall 46A of the side walls 46. The handle may aid with removal and/or insertion of the ice making tray 18. According to other examples, the handle may telescope out of the ice making tray 18 and/or may slide through the front wall 46A.

Figure 4:
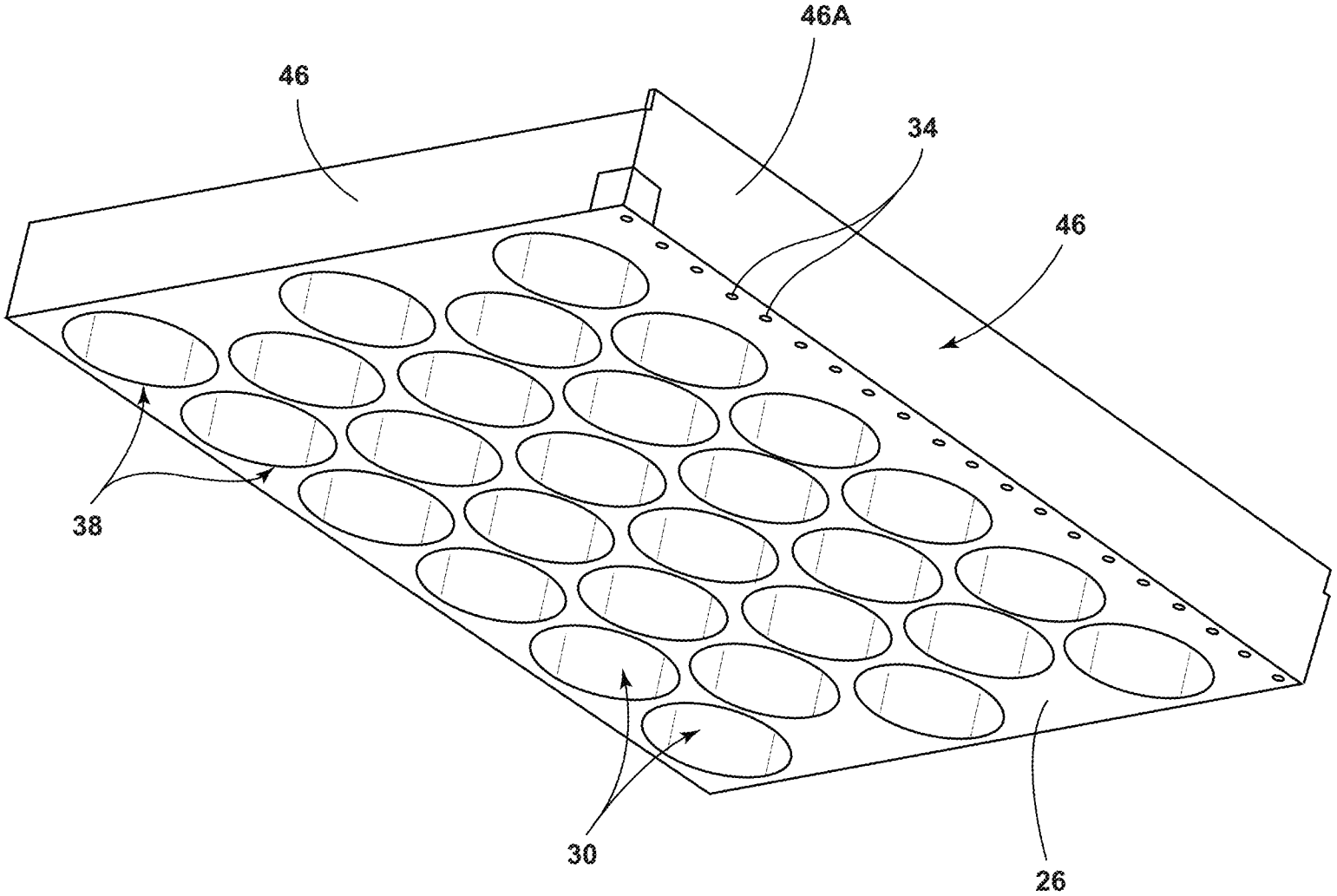
FIG. 4 is a perspective view of an ice making tray, according to at least one example.
Figure 5:
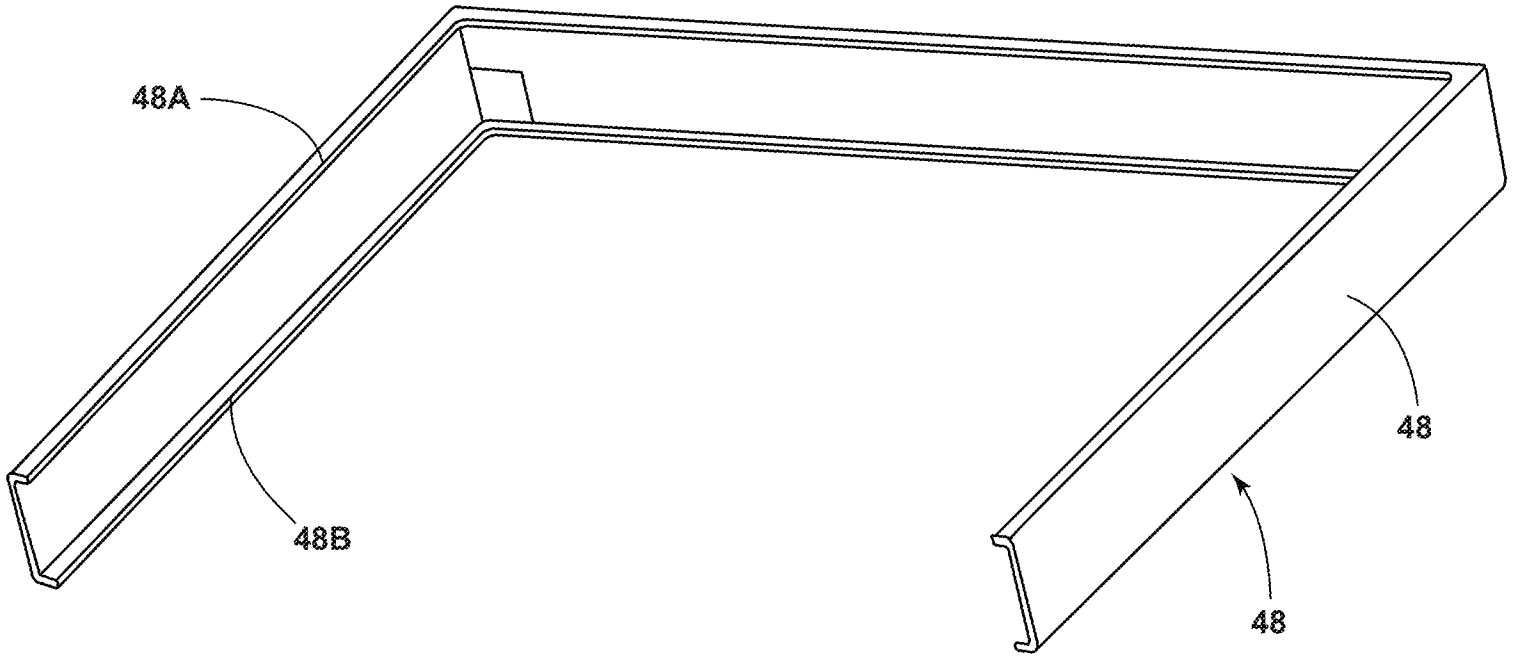
FIG. 5 is a perspective view of a frame, according to at least one example.
Figure 6:
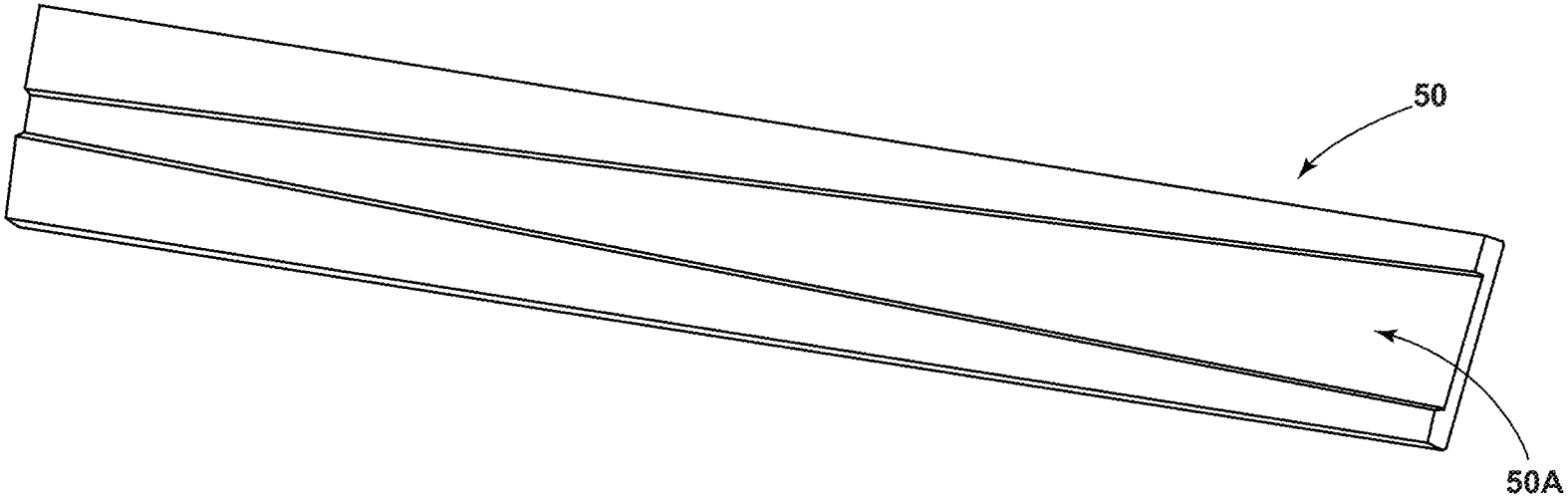
FIG. 6 is a perspective view of a frame piece, according to at least one example.

Referring now to FIGS. 4-6, according to some examples, an optional alignment member 50 is positioned on both sides of the ice tray 18. In other words, the side walls 46 may include two alignment members 50. The alignment members 50 are positioned on opposite sides of the side walls 46 than the tray space 18A. The alignment member 50 may define a groove 50A which is configured to accept a rail or protrusion of the frame 48. The groove 50A may be tapered such that a rear end of the groove 50A is wider than a front end of the groove 50A. In alternative examples, a front end of the groove 50A is wider than a rear end. The ice tray 18 may be configured to be held in place by positioning the alignment members 50 on the bottom lip 48B. Additionally or alternatively, the groove 50A may engage one or more of the top and bottom lips 48A, 48B. Use of tapered examples of the alignment members 50 may be advantageous in tilting the ice tray 18 such that wastewater flows to the second plurality of apertures 34. As such, the ice making tray 18 may be tilted within the ice maker 10. In an alternative example, the frame 48 may include a track which couples with the ice maker 10 such that that frame 48 may be removed from the ice maker 10. In another example, the side walls 46 may include wheels or rollers which slide on a shelf of the ice maker 10. The shelf may define indentations in which the wheels or rollers sit to lock the ice making tray 18 in place. Additionally or alternatively, the tray 18 and/or frame 48 may be coupled to a rail system which extends from the ice maker 10. Such an example may be advantageous in lowering the amount of force used to remove the ice making tray 18 from the ice maker 10.

The base 26 may be a flat sheet defining the first plurality of apertures 30 and the second plurality of apertures 34. The base 26 may be composed of a metal (e.g., food grade stainless steel), a polymeric material, a composite material and/or combinations thereof. According to various examples, the first plurality of apertures 30 may be larger than the second plurality of apertures 34. The first plurality of apertures 30 are configured to allow the ice pieces to fall through the base 26. The second plurality of apertures 34 are configured to allow wastewater (e.g., present in the tray space 18A) to drain from the base 26. The second plurality of apertures 34 may be positioned at a front of the ice making tray 18 proximate the first portion 46A of the side walls 46. For example, the ice making tray 18 may be positioned at an angle within the ice maker 10 such that waste water present in the tray space 18A may move toward the second plurality of apertures 34. It will be understood that the second plurality of apertures 34 may be positioned at other locations of the base 26. For example, the second plurality of apertures 34 may be positioned in a center region of the base or along other ends of the base 26. In yet another example, the second plurality of apertures 34 may extend across a whole of the base 26. The second plurality of apertures 34 may be smaller than the first plurality of apertures 30.

The ice forming features 38 are coupled to the base 26 proximate the plurality of first apertures 30 and extend upwardly in a perpendicular direction to the base 26. Additionally or alternatively, the ice forming features 38 may be integrally defined by the base 26. In examples where the ice forming features 38 are coupled to the base 26, a food grade sealing agent or adhesive may be used. In yet other examples, the ice forming features 38 may be welded to the base 26. The ice forming features 38 may be composed of the same material as the base 26 or may be made of a different material. For example, the base 26 may be composed of a first metal (e.g., aluminum) and the ice forming features 38 may be formed of a second metal (e.g., food grade stainless steel). The ice forming features 38 may include a thermally conductive material. Further, the ice forming features 38 may be formed of a material which has a higher thermal conductivity than the material of the base 26. The ice forming features 38 include a wall 38A defining a channel 38B therethrough. In the depicted example, the wall 38A forms a cylindrical channel 38B, but it will be understood that the wall 38A may take a variety of configurations to define a variety of shapes to the channel 38B. For example the wall 38A may define the channel 38B to have a heart shape, a star shape, a tree shape, a pumpkin shape, a butterfly or other shapes a consumer may desire the ice pieces to be. It will be understood that each of the ice forming features 38 may define a different shape. A top portion of the wall 38A may be sharpened or may be thin to aid in cutting of the ice pieces from the ice slab. The walls 38A of the ice forming features 38 may have a thickness of from about 0.1 mm to about 6 mm.

Figure 7:
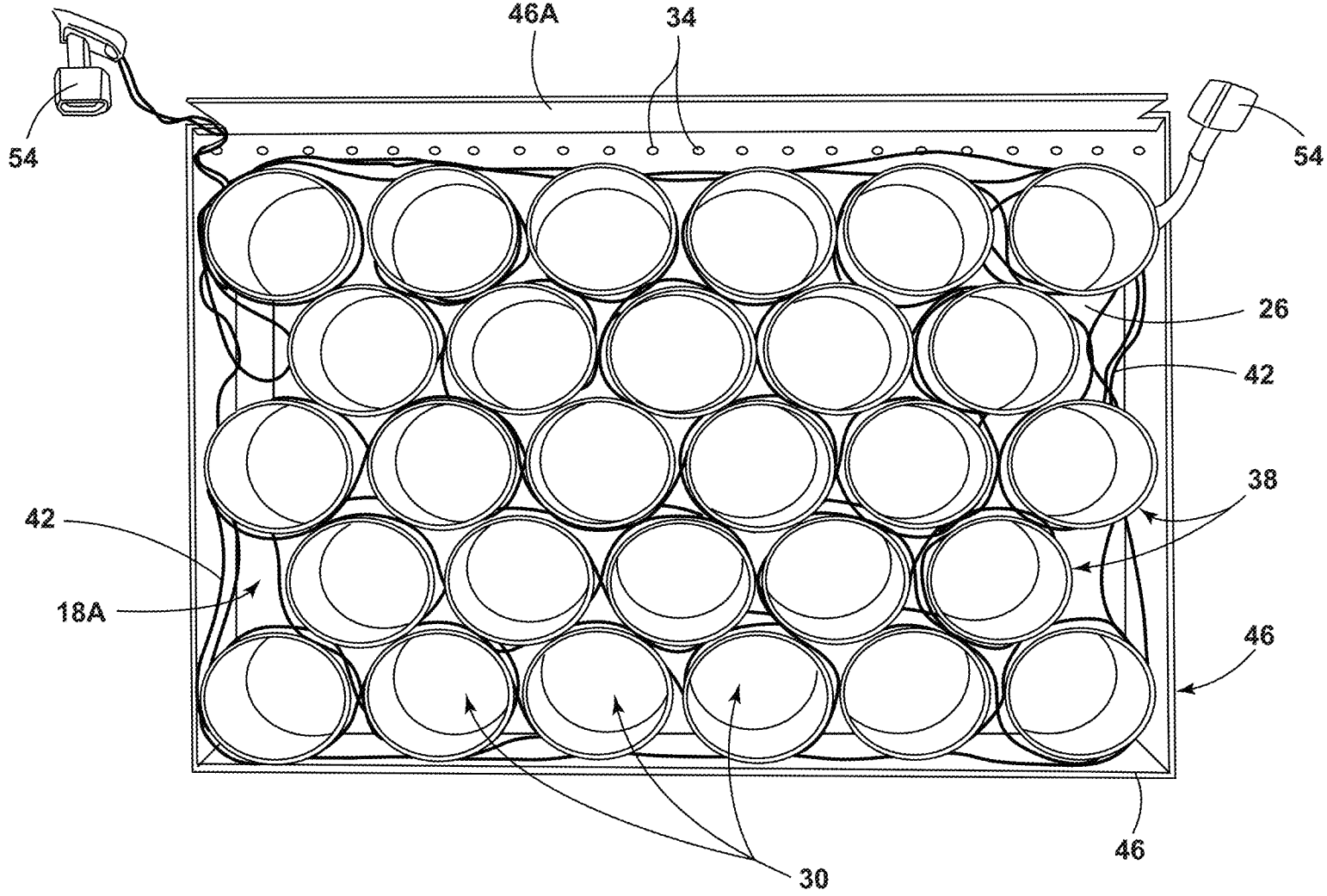
FIG. 7 is a top view of an ice making tray, according to at least one example.
Figure 8:
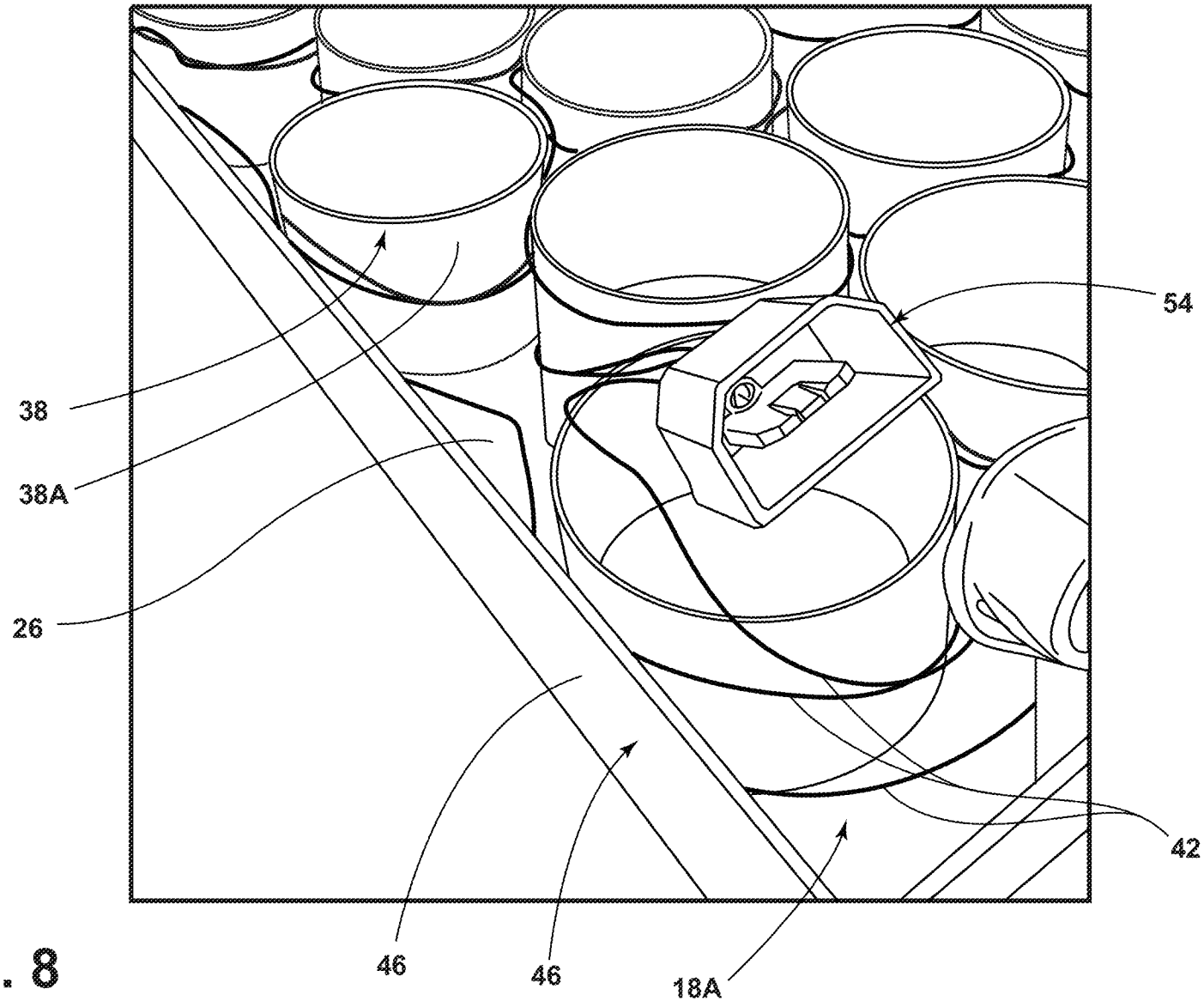
FIG. 8 is a perspective view of an electrical clip, according to at least one example.

Referring now to FIGS. 7 and 8, one or more heating elements 42 may be placed in thermal communication with the ice forming features 38. In the depicted example, the heating elements 42 are resistive wires which are interwoven between the ice forming features 38 in the tray space 18A. The resistive wires may be an Incoloy 825 wire and may be run in parallel. In other examples, the heating elements 42 may be induction coils, thermoelectric heaters and/or other forms of heating. For example, the waste heat from the cooling system used for the chilling plate may be transferred to the ice forming features 38 (e.g., through fluid lines or other structures). The heating elements 42 may have one or more layers of insulation positioned thereon. Electrical clips 54 are electrically coupled to the end of the heating elements 42. In the depicted example, the electrical clips 54 are clamshell clips, but it will be understood that a variety of types of electrical connectors may be used as the electrical clips 54 without departing from the teachings provided herein. The electrical clips 54 may be configured to provide electrical power to the heating elements 42 such that the ice forming features 38 may be heated, thereby increasing the ability of the ice forming features 38 to cut through the ice slab. The ice forming features 38 may be warmed to a temperature just above the freezing temperature of water (e.g., 1° C.) or to a higher temperature (e.g., 10° C., 20° C., 30° C., 40° C., 50° C.).

Figure 9:
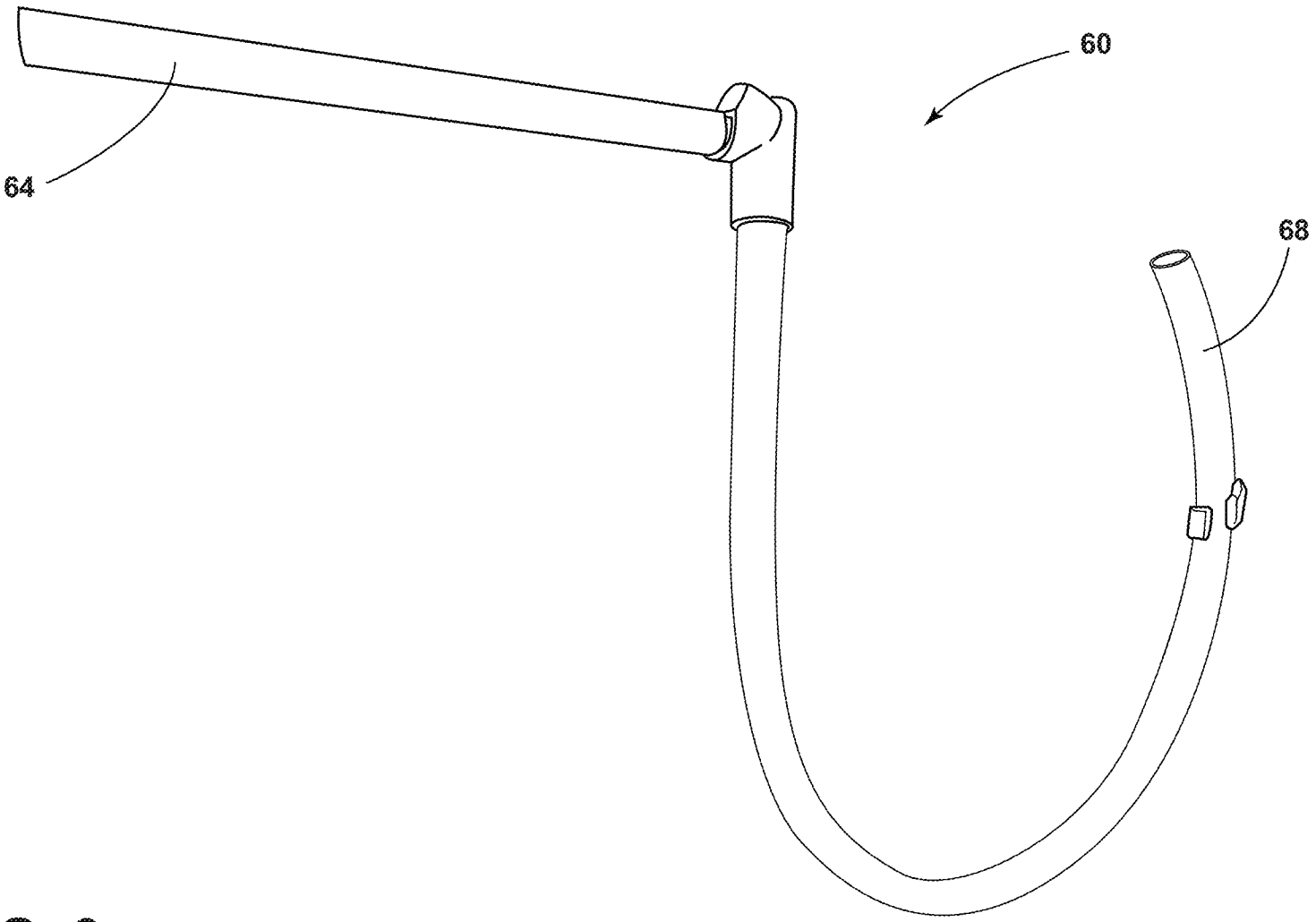
FIG. 9 is a perspective view of a wastewater disposal assembly, according to at least one example.

Referring now to FIG. 9, depicted is an example of a wastewater disposal assembly 60. The assembly 60 includes a trough 64 which catches water from the second plurality of apertures 34. As such, the second plurality of apertures 34 are fluidly coupled with the wastewater disposal assembly 60. The trough 64 may be coupled to an underside of the base 26. The trough 64 transfers water to a hose 68 which then returns the water to the ice slab forming portion of the ice maker 10 to be reused. The hose 68 is fluidly coupled to the trough 64. Alternatively, the wastewater may be removed from the ice maker 10. In some examples, the wastewater disposal assembly 60 is part of the ice making tray 18, while in other examples the wastewater disposal assembly 60 is integrally formed or permanently coupled to the wastewater disposal assembly 60.

Figure 10:
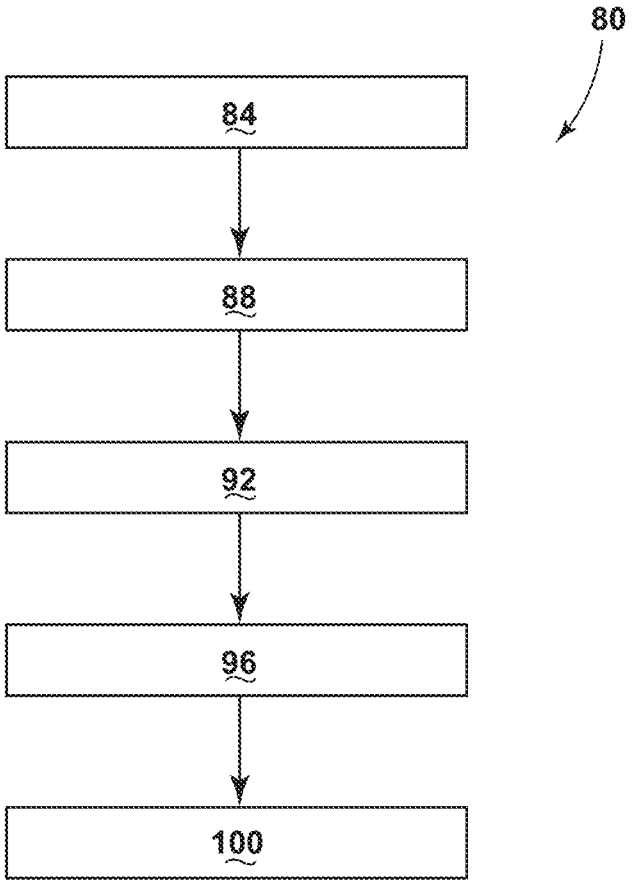
FIG. 10 is a flow chart of operating the ice maker, according to at least one example.

Referring now to FIG. 10, depicted is an exemplary method 80 of forming shaped ice. The method 80 may begin with a step 84 of forming the ice slab in the ice making unit 12. As explained above, water is dispensed onto a chilling plate within the ice making unit 12. As water flows across the chilling plate, the water solidifies as ice and concentrically builds layers of ice until the ice slab is formed. According to various examples, the ice formed from the ice making unit 12 may be substantially free of sediment and/or gas bubbles.

Next, a step 88 of dispensing the ice slab onto the ice making tray 18 to contact the plurality of ice forming features 38 is performed. As explained above, the ice forming features 38 generally extend away from the base 28 of the ice making tray 18. The ice forming features 38 have a general cross-sectional shape that corresponds to that of the desired shape of the final ice pieces.

Next, a step 92 of heating the plurality of ice forming features 38 such that the ice slab is separated into a plurality of ice pieces and waste ice is performed. It will be understood that the plurality of ice forming features 38 may be pre-warmed prior to dispensing of the ice slab onto the ice forming tray 18. For example, the heating elements 42 may warm the ice forming features 38 to above freezing prior to arrival of the ice slab. Further, the ice forming features 38 may be heated to temperatures in excess of 0° C. as the ice slab rests on the ice forming features 38. As explained above, the heating of the ice forming features 38 may be advantageous in quickening the separation of the ice pieces from the waste ice. The heat of the ice forming features 38, in cooperation with the weight of the ice slab, causes the ice forming features 38 to cut ice pieces from the slab. Step 92 may further include energizing a resistive element thermally coupled with the ice forming features 38. Further, the waste ice may fall into the tray space 18A as outlined above.

Next, a step 96 of passing the ice pieces through the ice forming features 38 is performed. As explained above, the walls 38A of the ice forming features 38 define channels 38B through which the ice pieces pass. The ice pieces generally take the shape of the channels 38B and as such fall from the ice tray 18 in the shape of the channel 38B. The ice pieces move through the channel 38B of the ice forming features 38 and exit the ice tray 18 through the first plurality of apertures 30.

Next, a step 100 of melting the waste ice into wastewater is performed. As the waste ice which has fallen into the tray space 18A is proximate the one or more heating elements 42, the waste ice will melt into water and travel toward the second plurality of apertures 34 defined within the base 26. It will be understood that thermal energy transferred to the ice forming features 38 may be conducted into the base 26 that a large portion of the ice tray 18 is warmed to a temperature above 0° C. and the waste ice is melted. Once the waste ice is melted into wastewater, the wastewater may be passed through the second plurality of apertures 34 in the ice making tray 18. As explained above, the wastewater may be collected in the wastewater disposal assembly 60 positioned below the ice tray 18.

Use of the present disclosure may offer a variety of advantages. First, use of the disclosed ice tray 18 with the ice forming features 38 may allow for the formation of uniquely shaped pieces. Second, use of the ice tray 18 allows for the quick change out of the ice tray 18 such that the shape of the ice pieces may be changed with little effort. Third, use of the ice tray 18 may allow for existing ice makers to be retrofitted to make shaped ice pieces.

Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims, as interpreted according to the principles of patent law, including the doctrine of equivalents.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

What is claimed is:

1. An ice maker comprising:
an ice making unit;
an ice storage bin;
a frame positioned between the ice making unit and the storage bin; and
an ice making tray coupled with the frame, comprising:
a base defining a first plurality of apertures and a second plurality of apertures;
a plurality of ice forming features positioned proximate the first plurality of apertures, wherein the ice forming features are coupled to and extend vertically upward and away from the base, and wherein the ice forming features develop ice pieces and waste ice; and
a heating element disposed on the base in thermal communication with the ice forming features; and
a wastewater disposal assembly coupled with the ice making tray.

2. The ice maker of claim 1, wherein the ice making unit is configured to produce an ice slab and dispense the ice slab onto the ice making tray.

3. The ice maker of claim 1, wherein the heating element comprises at least one resistive heating element.

4. The ice maker of claim 1, wherein the ice making tray further comprises a plurality of side walls and a front wall.

5. The ice maker of claim 4, wherein the front wall extends a greater distance from the base than the side walls.

6. The ice maker of claim 4, wherein the second plurality of apertures are positioned proximate the front wall.

7. The ice maker of claim 6, wherein the second plurality of apertures are smaller than the first plurality of apertures.

8. An ice maker comprising:
an ice making unit configured to form an ice slab;
a frame positioned proximate the ice making unit; and
an ice making tray coupled with the frame, comprising:
a base defining a first plurality of apertures and a second plurality of apertures;
a plurality of ice forming features positioned proximate the first plurality of apertures, wherein the ice forming features are coupled to and extend away from the base; and
a heating element in thermal communication with the ice forming features.

9. The ice maker of claim 8, further comprising:
a wastewater disposal assembly coupled with the ice making tray.

10. The ice maker of claim 9, wherein the wastewater assembly further comprises:
a trough positioned to catch wastewater from the ice making tray; and
a hose fluidly coupled to the trough.

11. The ice maker of claim 9, wherein the second plurality of apertures is fluidly coupled with the wastewater disposal assembly.

12. The ice maker of claim 8, wherein the first plurality of apertures is larger than the second plurality of apertures.

13. The ice maker of claim 8, wherein the ice making tray further comprises:
at least one alignment member configured to couple with the frame.

14. The ice maker of claim 13, wherein the at least one alignment member defines a tapered groove.

15. The ice maker of claim 9, wherein the ice making tray is tilted within the ice maker.

16. The ice maker of claim 9, wherein the ice forming features comprise a thermally conductive material.

17. A method of forming shaped ice, comprising the steps:
forming an ice slab in an ice making unit;
dispensing the ice slab onto an ice making tray to contact a plurality of ice forming features extending away from a base of the ice making tray;
heating the plurality of ice forming features such that the slab is separated into a plurality of ice pieces and waste ice;
passing the ice pieces through the ice forming features; and
melting the waste ice into wastewater.

18. The method of claim 17, further comprising the step of:
passing the wastewater through a plurality of apertures in the ice making tray.

19. The method of claim 18, further comprising the step of:
collecting the wastewater within a wastewater disposal assembly positioned below the ice tray.

20. The method of claim 19, wherein the step of heating the plurality of ice forming features further comprises the step of:
energizing a resistive element thermally coupled with the ice forming features.

* * * * *